United States Patent [19]

Smith

[11] Patent Number: 4,926,973

[45] Date of Patent: May 22, 1990

[54] MOBILE WHEELCHAIR LIFT AND BRAKES THEREFORE

[76] Inventor: Dave W. Smith, 238 Scarboro Ave., S. W., Calgary, Alta., Canada, T3C 2H3

[21] Appl. No.: 282,262

[22] Filed: Dec. 9, 1988

[51] Int. Cl.[5] ..... B66B 9/20

[52] U.S. Cl. ..... 187/11; 187/20; 187/27; 187/73; 187/93; 414/921; 254/378; 74/164

[58] Field of Search ..... 187/8.47, 8.49, 11, 187/9 R, 27, 20, 73, 93; 414/921; 254/354, 378; 74/813 C, 814, 824, 567, 568, 570, 144, 164

[56] References Cited

U.S. PATENT DOCUMENTS

| | | | |
|---|---|---|---|
| 2,420,903 | 5/1947 | Noble | 187/11 X |
| 2,603,372 | 7/1952 | Ketchpez | 187/9 R X |
| 3,291,260 | 12/1966 | Woor et al. . | |
| 3,435,915 | 4/1969 | Villars . | |
| 3,874,477 | 4/1975 | Hedstrom | 187/9 R |
| 3,994,476 | 11/1976 | Van Gennep | 254/378 |
| 4,133,437 | 1/1979 | Gates . | |
| 4,252,491 | 2/1981 | Hock | 187/9 R |
| 4,347,030 | 8/1982 | Kingston . | |
| 4,493,479 | 1/1985 | Clark | 254/378 |
| 4,493,602 | 1/1985 | Koerber . | |
| 4,499,970 | 2/1985 | Hussey . | |
| 4,576,539 | 3/1986 | Williams . | |

FOREIGN PATENT DOCUMENTS

| | | | |
|---|---|---|---|
| 2055344 | 3/1981 | United Kingdom | 414/921 |

*Primary Examiner*—Joseph J. Rolla
*Assistant Examiner*—Kenneth DeRosa
*Attorney, Agent, or Firm*—Irell & Manella

[57] ABSTRACT

A lightweight frame supports a wheelchair platform for up and down movement between four vertical standards, one at each corner. A lifting mechanism includes a winch supported between two of the standards and connected to the platform by cables which pass over pulleys mounted in an upper cross bar pivotally secured and extending between the two posts with the pivot being offset from the longitudinal axis of the crossbar thereby giving a camming or offset partial rotational movement. The winch includes a one way clutch which is disengaged when the platform is elevated but engages automatically as soon as the platform starts to descend thus locking a brake drum to the winch. A brake band extends around the drum and is operatively connected to an offset pin on the upper crossbar by rigid links so that as soon as the platform starts to descend, the brake is automatically applied thus preventing inadvertent downward movement of the platform unless the friction or resistance between the drum and band is overcome by actuation of the winch for controlled lowering of the platform. Wear is automatically compensated for by the linkage between the brake pad and the pin on the upper cross bar which acts in a camming fashion with the offset pivot mounting thereof.

20 Claims, 4 Drawing Sheets

MOBILE WHEELCHAIR LIFT AND BRAKES THEREFORE

BACKGROUND OF THE INVENTION

This invention relates to new and useful improvements in mobile wheelchair lifts and in particular, automatic fail safe braking systems therefore.

The present device is designed specifically to raise a person in a wheelchair from the platform level up to a rail car level and vice versa although of course it may be used in other environments.

The alternative to this present device is to install powered lifts attached directly to the rail cars, but this has been abandoned by the railways as prohibitively expensive and impractical.

However, both manually operated and power driven types of wheelchair lifts are known and the following prior art is exemplary.

U.S. Pat. No. 3291260 issued Dec. 13, 1966 to D.F. Woor et al. This discloses a vehicle lift apparatus including a pulley system and safety mechanisms which prevent downward movement of the platform if the supporting cable becomes slack.

U.S. Pat. No. 3435915 issued Apr. 1, 1969 to J. Villars shows a lifting installation including a fail safe arrangement which is operative if a cable becomes slack or fractures.

U.S. Pat. No. 4133437 issued Jan. 9, 1979 to F. Alan Gates shows a device in which the platform is mounted on a rotatable post in front of a doorway in the side of a van and is operated electrically. This has a belt and pulley drive with the belt being frictionally restrained to prevent inadvertent or unwanted lowering.

U.S. Pat. No. 4347030 issued Aug. 31, 1982 to John C. Kingston shows a loading and detraining apparatus with a horizontal loading platform which is pivotally connected to a pair of spaced apart and opposed linkage means. This is a stationary apparatus and is particularly suited for lifting wheelchairs over stairwells in the vestibule of a train coach. It utilizes a balk lever for raising the platform.

U.S. Pat. No. 4493602 issued Jan. 15, 1985 to Charles F. Koerber. This discloses a lift apparatus of rotary construction which includes a brake system for the lift assembly and automatically lifts the wheelchair user from the ground into the van and vice versa. It includes a fail safe braking system.

U.S. Pat. No. 4499970 issued Feb. 19, 1985 to Ian G. Hussey. This shows a lifting platform for a transit system and utilizes a set of rotating actuating arms to raise and lower the platform. It utilizes a chain drive and sprocket wheel combination.

U.S. Pat. No. 4576539 issued Mar. 18, 1986 to Harold R. Williams. This is a curb side lift apparatus for transferring wheelchair passengers to and from trains and public transit vehicles. This is a stationery device utilizing a chain and sprocket arrangement for raising and lowering the platform.

The present device includes several significant features which include the fact that it is extremely light and easy to handle because of the extensive use of aluminum in the construction thereof.

Secondly, it is easily portable due to the fact that when the platform is in the lowermost position, the frame is raised and the ground engaging wheels under the platform enable it to be moved from one location to another readily and easily.

It is designed primarily for use with a manual cranking system which is extremely efficient and includes a braking system that is activated by the load on the wheelchair deck so that the manual effort required to crank the lift downwardly is proportional to the load on the deck.

The required high degree of safety and reliability in the braking and holding system is obtained by providing two band brakes in connection with a spring loaded retracting crank thus giving two safety methods to prevent inadvertent descent of the loading platform during use.

Another advantage of the invention is the automatic compensation for wear occurring between the brake bands and brake drums and the fact that the efficiency of the brakes can be adjusted readily and easily.

In accordance with the invention there is provided a mobile wheelchair lift comprising in combination a base frame, a vertically situated support structure extending upwardly from adjacent each end of said base frame, a substantially horizontal wheelchair platform, a winch assembly including a cable drum and a cable system operatively connected thereto, and supporting said platform between said support structure for elevating and lowering action within said support structure, said cable system including at least one upper pulley, upper pulley support means and a cable operatively extending between said cable drum and said upper pulley, and an automatic braking system cooperating between said winch assembly and said platform to prevent inadvertent descent of such platform, said braking system including at least one brake drum means operatively connected to said cable drum, brake means operatively connected to said brake drum means, and operating link means operatively extending between said upper pulley support means and said brake means to actuate said brake means, said upper pulley support means including a cam action therein for pivotally supporting same to said vertical support structure whereby the initiation of descent of said platform moves said link means to actuate said brake means.

In accordance with a further advantage of the invention, there is provided an automatic braking system for mobile wheelchair lifts in which said wheelchair lift includes a base frame, vertically situated support structure extending upwardly from at least each end of said base frame and a substantially horizontal wheelchair plateform mounted within said support structure, a winch assembly including a cable drum, and a cable system within said support structure and operatively connected to said platform for selective elevating and lowering said platform within said support structure, said cable drum rotating in one direction when said platform is elevating and in the opposite direction when said platform is descending; said braking system including automatically operating means to prevent inadvertent descent of said platform, said automatically operating means including brake drum means and brake means operatively connected to said brake drum means both operatively associated with said cable drum, one way clutch means to engage said brake drum means and said cable drum when said cable drum starts to rotate in said opposite direction, an upper pulley system for said cable system, pulley support means for said upper pulley systems situated adjacent the upper end of said vertically situated support structure, operating a link means operatively extending between said upper pulley support means and said brake means to actuate said brake means, said upper pulley support means including a cam action therein for pivotally supporting same to said vertical support structure whereby the initiation of descent of said platform moves said operating link means to actuate said brake means.

A still further advantage of the invention is to provide a device of the character herewithin described which is simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
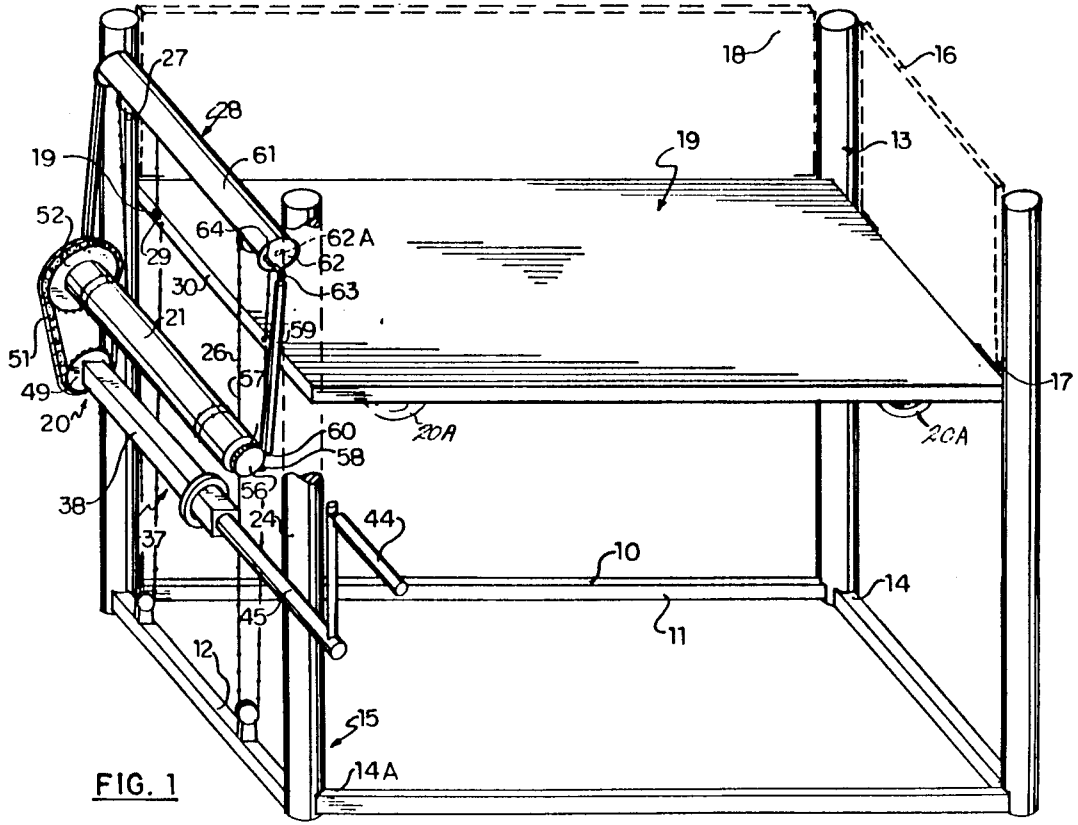
FIG. 1 is a partially schematic isometric view of the wheelchair lift showing the braking system with certain parts removed for clarity.

Proceeding therefore to describe the invention in detail, reference should first be made to FIG. 1 which shows a substantially rectangular base frame 10 having longitudinal members 11 and transverse members 12. Vertically situated support structure is provided and in this embodiment takes the form of a first pair of vertically situated standards collectively designated 13 with each standard extending upwardly from the corner areas 14 of the base frame 10.

A second pair of vertically situated standards collectively designated 15 extend upwardly one from each of the adjacent corner areas 14A of the base frame.

Shown in phantom is an end ramp 16 hinged to the front of the deck 19 by means of a transverse hinge 17 and foldable ownwardly to the railcar doorway.

A side ramp is also shown in phantom and identified by reference character 18 which is hinged horizontally as indicated by 19 along one side of the deck 19 and is capable of being hinged downwardly to a ground engaging position when the deck 19 near ground level.

A substantially rectangular wheelchair carrying deck is indicated by reference character 19 and is provided with ground engaging wheels 20A on the under side thereof, two of which are shown in FIG. 1 and this platform 19 is adapted to be raised and lowered within the four standards 13 and 15 by means of a winch assembly collectively designated 20 and which is situated at one end of the wheelchair lift and upon the second pair of vertical standards 15.

The winch assembly includes a cylindrical winch drum 21 supported on end shafts 22 which in turn are journalled for rotation within bearings 23 secured to the outboard sides 24 of the standards 15. The shafts are secured to end plates 24 within the cylindrical winch drum 21 and each shaft 22 also carries a conventional one-way clutch 25 on the inner end thereof and within the drum 21. These one-way clutches, which may consist of a ratchet and pawl assembly or a ball bearing and ramp type of clutch, cooperate between the drum 25 and the shafts 22 to permit the drum 21 to rotate freely on the shafts 22 when rotating in a clockwise direction with reference to FIG. 1 but which lock up and lock the to the shaft 22 when rotation commences in the opposite or anti-clockwise direction once again with reference to FIG. 1, the purpose of which will hereinafter become apparent.

Cables 26 are wound several times around the periphery of drum 21 and are wound or unwound from the drum depending upon the direction of rotation thereof. One end of these cables extend upwardly and around upper pulleys 27 journalled for rotation within an upper pulley support collectively designated 28 and then extend downwardly to be connected as at 29 to one end 30 of the platform 19. The other end of these cables extend downwardly and around lower pulleys 27A journalled for rotation on lower pulley support 28A and then extend upwardly to be connected as at 29A to said one end 30 of the platform 19.

Figure 4:
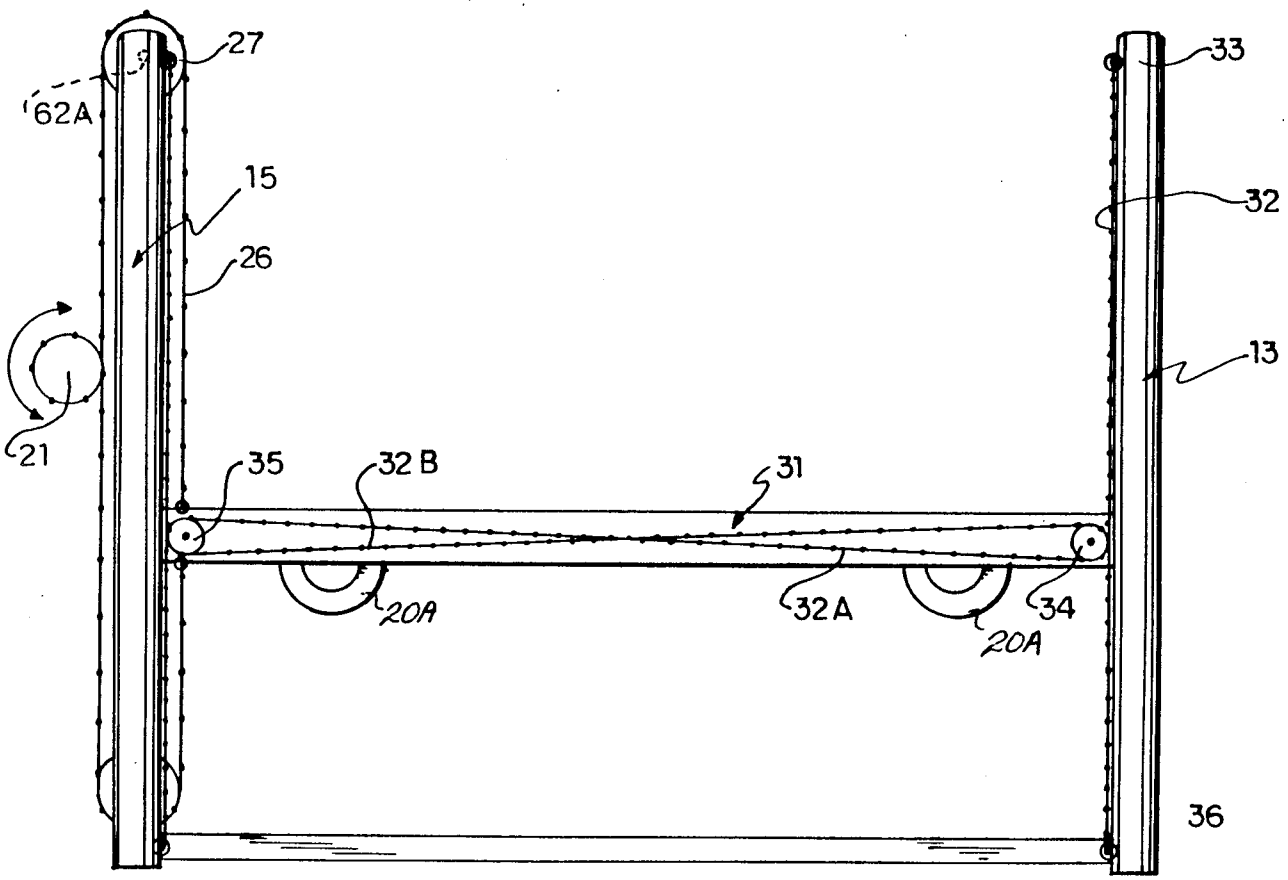
FIG. 4 is a fragmentary side elevation partially schematic and showing the paralleling cable system.
Figure 6:
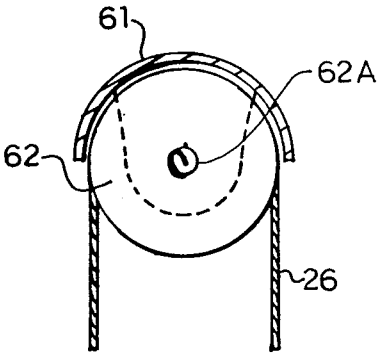
FIG. 6 is a fragmentary section along the line 6—6 of FIG. 2.

FIG. 4 shows a conventional parallel cable assembly collectively designated 31 which maintains the deck or platform 19 in the horizontal position during the elevating and lowering thereof. Although this is conventional; it includes further cables 32 each secured by one end thereof to adjacent the upper ends 33 of the first standards 13 and which then extend downwardly around pulleys 34 journalled within each side edge of the platform 19. The cable runs 32A extend diagonally along the side edges and over further pulleys 35 journalled at the opposite ends of the side edges of the platform and then extends back with the runs illustrated at 32B, diagonally to the upper sides of pulleys 34 and then downwardly to the lower anchors 36. Although single pulleys 34 and 35 are shown, pulley 34 is preferably in the form of double pulleys to take the opposing runs of this cable. As the deck is raised or lowered from the one end 30, it is maintained in a parallel and horizontal position by the cable assembly 31 on each side thereof.

Means are provided to actuate the winch assembly and take the form of a hand crank assembly collectively designated 37 mounted on the outside 24 of the standards 15 and below the winch drum 21.

It consists of a main drive portion 38 which in this embodiment is formed from square tubing supported by a shaft 39 extending from one end thereof and journalled for rotation within a bearing 40 secured to the outside 24 of one of the standards 15 and spaced from this standard a predetermined amount.

Figure 2:
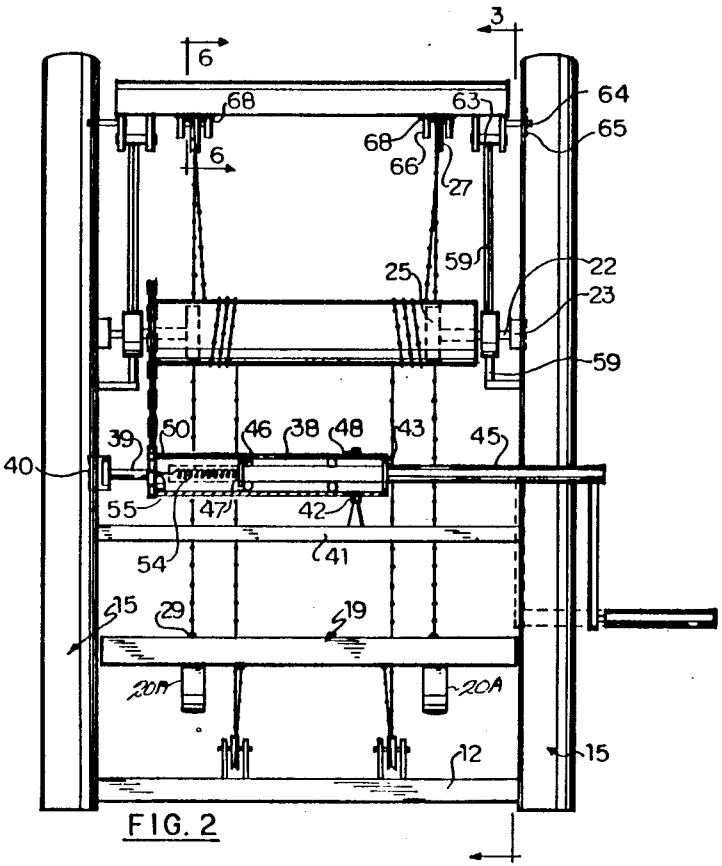
FIG. 2 is a left hand end view of FIG. 1.

A cross bar 41 supports a bearing 42 adjacent the inner end 43 of this portion 38 and this bearing 42 supports the inner end of the portion 38 as shown in FIG. 2.

A handle crank 44 is secured to a crank drive shaft 43 which engages within the open inner end 43 of the portion 38 and this drive shaft is cylindrical in configuration.

Figure 3:
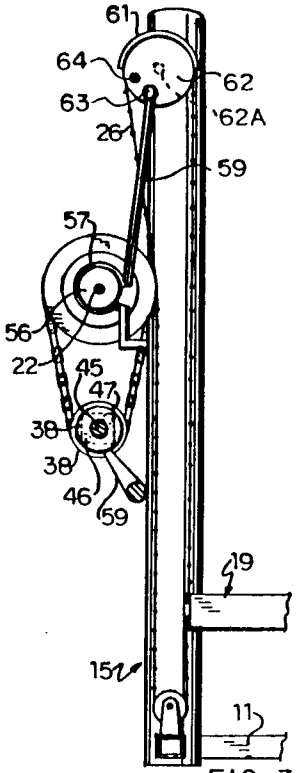
FIG. 3 is a section substantially along the line 3—3 of FIG. 2.

Reference to FIG. 3 will show an end view of this portion 38 with the cylindrical drive shaft 43 engaging therein and being mounted within the square tube portion 38 by means of ball bearings 46 which are situated between the shaft 43 and the corners 47 of the interior of the portion 38. There are two pairs of these ball bearings 46 which are restrained in position by an end cap 47 on the inner end of shaft 45 and by apertured end cap lugs 48 adjacent the open end 43 of the portion 38. These ball bearings permit the shaft 45 and the hand crank 44 to move inwardly and outwardly relative to the portion 38 but which lock the two together so that rotation of the hand crank 44 will rotate the portion 38. The shaft extends freely through the aperture end cap 48.

A sprocket 49 is secured to the other end 50 of the portion 38 and a chain 51 extends around the sprocket and around a further sprocket 52 secured to one end 53 of the cable drum 21. The spacing of the crank assembly and 45 and portion 38 from the sides 24 of the standards, prevents rotation of the hand crank when same is in the innermost position. The innermost position which is shown in phantom in FIG. 2, is the normal position for the hand crank due to a tension spring 54 extending between the innermost end of the drive shaft 45 and an anchor 55 on the end 50 of the portion 38. This spring is shown in FIG. 2. When in the innermost position, the hand crank cannot revolve but when it is pulled outwardlY against pressure of spring 54, it may be rotated thus rotating the cable drum 21 and winding or unwinding the cables 26 thereon which in turn raises or lowers the platform 19.

An automatic braking system is provided and consists of a pair of brake drums 56, one each being secured to shafts 22 mounting the winch drum 21.

An externally contracting brake band 57 surrounds each drum and is anchored by one end 58 thereof upon a bracket 59 extending from the vertical members 15. This is shown in FIG. 2.

Figure 5:
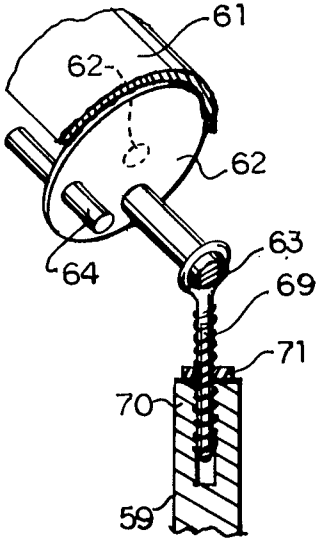
FIG. 5 is a fragmentary isometric view of one end of the upper cross bar mount per se.

An adjustable rigid brake actuating link 59 is secured by one end thereof to the free end 60 of the brake band and extends upwardly towards the upper pulley supporting member 28. This member 28 takes the form of a transversely situated cross bar which includes a semi-cylindrical upper portion 61 having two pairs of disks or links 62 secured thereto and depending downwardly therefrom, one pair being adjacent one end of the cylindrical shroud 61 and the other pair, adjacent the other end thereof. An upper cross pin 63 spans each pair of disks or links 62 and the upper end of the rigid link 59 is bearably supported upon this pivot pin as shown in FIG. 5 in which one of the disks has been removed for clarity.

A cross bar pivot pin 64 extends outwardly from adjacent the periphery of the disks or links 62 and is journalled for partial rotation within bearings 65 offstanding from the outsides 24 of the vertical standards 15 so that an eccentric or cam action is provided if the upper cross bar partially rotates around its pivots 64.

Further pairs of disks or links 66 depend from the under side of the semi-circular shrouds 61 inboard of the disks or links 62 and cable pulleys 27 are journalled for rotation upon mounting or pivot pins 68 which extend between the disks or lugs 66 and are substantially in alignment with the longitudinal axis of the upper cross bar as shown in phantom within the disks 62.

The geometry of the mounting axis of the pulleys 27 indicated by the pivot pins 68, together with the mounting pivots 64 of the cross bar and the actuating pins 63 are such that an automatic braking system is provided as follows.

When the crank 44 is rotated clockwise with reference to FIG. 1, the clutches 25 are disengaged and the drum 21 rotates freely thus winding the cables 26 around the drum thereby raising the platform 19 which is maintained parallel by the paralleling cable assembly 31.

In order to rotate hand crank 44, it will be appreciated that it must be pulled outwardly from the portion 38 so that it can be rotated clear of the standard 15.

As soon as the platform is raised the desired amount and the hand crank is released, the hand crank will of course move inwardly pulled by spring 54 and the platform will attempt to descend not only by its own weight but by the weight of any wheelchair and occupant that may be thereon. As soon as downward movement commences, the drum 21 attempts to rotate in the opposite direction or anti-clockwise with reference to FIG. 1 and immediately the one way clutches 25 lock the drum 21 to the brake drums 56. At the same time the weight of the platform 19 tensions the cables 26 which pulls o the pulley 27 thus attempting to rotate the cross bar 28 also clockwise with respect to FIG. 1. This moves pins 63 in an arc clockwise with respect to FIG. 1 thus forcing the links 59 downwardly and applying the brake bands to the brake drum and immediately preventing the platform 19 from moving downwardly.

If it is desired to lower the platform, then the hand crank 44 must be pulled outwardly and rotated anti-clockwise with respect to FIG. 1 overcoming the friction between the brake drums 56 and the brake bands 57 and controlling the lowering of the platform as required.

The aforementioned hand crank 44 being spring loaded inwardly, immediatelY moves inwardly as soon as it is released and acts a secondary fail safe type of brake inasmuch as it can only rotate at the most 180° before it strikes the standard 15 and is prevented from any further rotation so that the platform 19 will stop descending immediately.

The links 59 are adjustable in length by the provision of a screw threaded end 69 screw threadably engagable within the end 70 of the link 59 and being maintained in the desired position by means of lock nuts 71.

The braking force may be adjusted by lengthening or shortening of the links 59. For example, if the links are lengthened, then the cross pins are partially rotated anti-clockwise with reference to FIG. 1 about the cross bar pivot pins 44 thus giving the upper cross bar members 28 less leverage at the cross pins 63 and the braking force is thereby reduced. By contrast, the braking force can be increased by shortening the brake activating links 59.

The wheelchair lift assembly, when used on railroads, may be parked on the railway platform when not in use. When a train arrives and a wheelchair is to be loaded or unloaded, the platform 19 is cranked downwardly by hand crank 44 thereby bringing the ground engaging wheels 20 in contact with the ground and lifting the main frame 10 clear of the ground. The assembly may then be pushed by hand and located opposite the rail car door (rot illustrated) and with the platform at ground level, the wheelchair may be loaded onto the platform 19. The hand crank 44 may then be pulled out against pressure of spring 54 and the platform cranked manually to the level of the railcar. The wheelchair may then be transferred by means of a short ramp (not illustrated) into or out of the railcar vestibule as desired.

The manual cranking system has an efficiency of approximately 90% because of the combined chain cable drive which is essential to minimize the time and effort required to load the wheelchair.

The automatic braking system is activated by the load on the wheelchair platform 19 so that the manual effort required to crank the platform 19 downwardly is proportional to the load on the platform.

In practice, it has been found desirable to set the brakes at approximately 150% of the torque required to hold the load which means that the manual effort requires to crank the platform 19 downwardly is about half the effort required to crank it upwardly.

A high degree of safety and reliability is obtained in braking the holding system and this is provided by the two band brakes in combination with the secondary, spring-loaded retracting crank when the wheelchair platform 19 is to be lowered, the crank handle 44 is pulled outwardly and turned counterclockwise. It will be appreciated that during this operation the one-way clutches 25 remain engaged and force the brake drums 56 to turn against the friction provided by the brake bands 57 and of course the downward cranking force must overcome this friction in order for the platform 19 to move downwardly.

As the brakes wear, the load applied to the band increase because of the geometry of the upper cross bar and the pins associated therewith because the pins 63 move clockwise towards the mounting pins 64.

This gives the cables more leverage to affect the links 59 thereby increasing the load on the brake bands.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A mobile wheelchair lift comprising in combination a base frame, a vertically situated support structure extending upwardly from adjacent each end of said base frame, a substantially horizontal wheelchair platform, a winch assembly including a cable drum and a cable system operatively connected thereto, and supporting said platform between said support structure for elevating and lowering action within said support structure, said cable system including at least one upper pulley and at least one lower pulley, upper and lower pulley support means and a cable operatively extending between said cable drum and said upper and lower pulleys, and an automatic braking system cooperating between said winch assembly and said platform to prevent inadvertent descent of said platform, said braking system including at least one brake drum means operatively connected to said cable drum, brake means operatively connected to said brake drum means, and operating link means operatively extending between said upper pulley support means and said brake means to actuate said brake means, said upper pulley support means including a cam action therein for pivotally supporting same to said vertical support structure whereby the initiation of descent of said platform moves said link means to actuate said brake means.

2. The wheelchair lift according to claim 1 in which said winch assembly includes a winch handle assembly operatively connected to said winch drum, said winch handle assembly including a main drive portion journalled for rotation in said vertical support structure a winch handle crank, a drive shaft extending from said winch handle crank and slideable endwise within said main drive portion to rotate said main drive portion in either direction, and means associated with said winch handle crank to provide secondary means to prevent inadvertent descent of said platform, said secondary means including said means supporting said main drive portion spaced from said vertical support structure, means cooperating between said drive shaft and said main drive portion whereby said drive shaft can rotate said main drive portion in either direction, spring means operatively connecting the inner end of said drive shaft with the other end of said main drive portion and normally holding said winch handle crank and said drive shaft in the innermost retracted position, said winch handle crank engaging said vertical support structure when in said retracted position whereby said winch handle crank cannot rotate, outward movement of said winch handle crank and said drive shaft against tension of said spring means, clearing said winch handle crank from said vertical support structure thereby enabling rotation of said winch handle crank and said shaft and hence said winch drum.

3. The wheelchair lift according to claim 1 in which said upper pulley support means includes a transverse member, said cam action including a pivot pin means offset from the longitudinal axis of said member and mounting said member for partial rotation about said longitudinal axis, to one end of said vertical support structure, said pulley being journalled for rotation to said transverse member and having an axis of rotation substantially along the longitudinal axis of said transverse member, initiation of the descent of said platform partially rotating said transverse member thereby moving said link means to actuate said brake means.

4. The wheelchair lift according to claim 3 in which said cable drum is rotatable in one direction when said platform is elevating and in the opposite direction when said platform is descending and one way clutch means operatively engaging between said cable drum to said brake drum when said cable drum begins to rotate in said opposite directions.

5. The wheelchair lift according to claim 2 in which said winch assembly includes a winch handle assembly operatively connected to said winch drum, said winch handle assembly including a main drive portion journalled for rotation in said vertical support structure a winch handle crank, and drive shaft extending from said winch handle crank and slideable endwise within said main drive portion to rotate said main drive portion in either direction, and means associated with said winch handle crank to provide secondary means to prevent inadvertent descent of said platform, said secondary means including said means supporting said main drive portion spaced from said vertical support structure, means cooperating between said drive shaft and said main drive portion whereby said drive shaft can rotate said main drive portion in either direction, spring means operatively connecting the inner end of said drive shaft with other end of said main drive portion and normally holding said winch handle crank and said drive shaft in the inner most retracted position, said winch handle crank engaging said vertical support structure when in said retracted position whereby said winch handle crank cannot rotate, outward movement of said winch handle or crank and said drive shaft against tension of said spring means, clearing said winch handle crank from said vertical support structure thereby enabling rotation winch drum.

6. The wheelchair lift according to claim 3 in which the geometry between said pivot pin means and said axis of rotation of said pulleys is such that as said brake means wears, the leverage applied by the rotation of said winch drum within said opposite direction increases thereby automatically increasing the braking action as the wear increases on said brake means.

7. The wheelchair lift according to claim 3 in which said vertically situated support structure includes a pair of vertically situated standards extending upwardly at one end of said base frame and a further pair of vertically situated standards extending upwardly from the other end of said base frame, said transverse member being journalled for said partial rotation to adjacent the upper ends of said first mentioned pair of vertical standards, and at least one cable extending from said cable drum, over said upper pulley and being operatively connected to said platform and over said lower pulley and being operatively connected to said platform, and a parallel cable assembly operatively connected between said platform and said second mentioned pair of vertical standards, to maintain said platform substantially horizontally.

8. The wheelchair lift according to claim 7 in which said cable drum is rotatable in one direction when said platform is elevating and in the opposite direction when said platform is descending and one way clutch means operatively engaging between said cable drum and said brake drum to selectively lock said cable drum to said brake drum when said cable drum begins to rotate in said opposite directions.

9. The wheelchair lift according to claim 7 in which said winch assembly includes a winch handle assembly operatively connected to said winch drum, said winch handle assembly including a main drive portion journalled for rotation in said vertical support structure a winch handle crank, and drive shaft extending from said winch handle crank and slideable endwise within said main drive portion to rotate said main drive portion in either direction, and means associated with said winch handle crank to provide secondary means to prevent inadvertent descent of said platform, said secondary means including said means supporting said main drive portion spaced from said vertical support structure, means cooperating between said drive shaft and said main drive portion whereby said drive shaft can rotate said main drive portion in either direction, spring means operatively connecting the inner end of said drive shaft with other end of said main drive portion and normally holding said winch handle crank and said drive shaft in the innermost retracted position, said winch handle crank engaging said vertical support structure when in said retracted position whereby said winch handle crank cannot rotate, outward movement of said winch handle or crank and said drive shaft against tension of said spring means, clearing said winch handle crank from said vertical support structure thereby enabling rotation of said winch handle crank and said shaft and hence said winch drum.

10. The wheelchair lift according to claim 1 in which said cable drum is rotatable in one direction when said platform is elevating and in the opposite direction when said platform is descending and one way clutch means operatively engaging between said cable drum and said brake drum to selectively lock said cable drum to said brake drum when said cable drum begins to rotate in said opposite direction.

11. The wheelchair lift according to claim 10 in which said winch assembly includes a winch handle assembly operatively connected to said winch drum, said winch handle assembly including a main drive portion journalled for rotation in said vertical support structure a winch handle crank, and drive shaft extending from said winch handle crank and slideable endwise within said main drive portion to rotate said main drive portion in either direction, and means associated with said winch handle crank to provide secondary means to prevent inadvertent descent of said platform, said secondary means including said means supporting said main drive portion spaced from said vertical support structure, means cooperating between said drive shaft and said main drive portion whereby said drive shaft can rotate said main drive portion in either direction, spring means operatively connecting the inner end of said drive shaft with other end of said main drive portion and normally holding said winch handle crank and said drive shaft in the innermost retracted position, said winch handle crank engaging said vertical support structure when in said retracted position whereby said winch handle crank cannot rotate, outward movement of said winch handle or crank and said drive shaft against tension of said spring means, clearing said winch handle crank from said vertical support structure thereby enabling rotation of said winch handle crank and said shaft and hence said winch drum.

12. The wheelchair lift according to claim 10 in which rotation of said cable drum in said opposite direction by said winch assembly overcomes the effective said braking system whereby said platform descends in a controlled manner.

13. An automatic braking system for mobile wheelchair lifts in which said wheelchair lift includes a base frame, vertically situated support structure extending upwardly from at least each end of said base frame and substantially horizontal wheelchair platform mounted within said support structure, a winch assembly including a cable drum, and a cable system within said support structure and operatively connected to said platform for selective elevating and lowering said platform within said support structure, said cable drum rotating in one direction when said platform is elevating and in the opposite direction when said platform is descending; said braking system including automatically operating means to prevent inadvertent descent of said platform, said automatically operating means including brake drum means and brake means operatively connected to said brake drum means both operatively associated with said cable drum, one way clutch means to engage said brake drum means and said cable drum when said cable drum starts to rotate in said opposite direction, an upper and lower pulley system for said cable system, pulley support mean for said upper and lower pulley systems situated adjacent the upper and lower ends of said vertically situated support structure respectively, said upper pulley system operating a link means operatively extending between said upper pulley support means and said brake means to actuate said brake means, said upper pulley support means including a cam action therein for pivotally supporting same to said vertical support structure whereby the initiation of descent of said platform moves said operating link means to actuate said brake means.

14. The wheelchair lift according to claim 13 in which said winch assembly includes a winch handle assembly operatively connected to said winch drum, said winch handle assembly including a main drive portion journalled for rotation in said vertical support structure a winch handle crank, a drive shaft extending from said winch handle crank and slideable endwise within said main drive portion to rotate said main drive portion in either direction, and means associated with said winch handle crank to provide secondary means to prevent inadvertent descent of said platform, said secondary means including said means supporting said main drive portion spaced from said vertical support structure, means cooperating between said drive shaft and said main drive portion thereby said drive shaft can rotate said main drive portion in either direction, spring means operatively connecting the inner end of said drive shaft with the other end of said main drive portion and normally holding said winch handle crank and said drive shaft in the innermost retracted position, said winch handle crank engaging said vertical support structure when in said retracted position whereby said winch handle crank cannot rotate, outward movement of said winch handle crank and said drive shaft against tension of said spring means, clearing said winch handle crank from said vertical support structure thereby enabling rotation of said winch handle crank and said shaft and hence said winch drum.

15. The braking system according to claim 13 in which said link means is adjustable in length to vary the braking affect of said braking system.

16. The braking system according to claim 13 in which said upper pulley support system means includes a transverse member, said cam action including a pivot pin means offset from the longitudinal axis of said member and mounting said member for partial rotation about said longitudinal axis, to one end of said vertical support structure, said pulley being journalled for rotation to said transverse member and having an axis of rotation substantially along the longitudinal axis of said transverse member, initiation of the descent of said platform partially rotating said transverse member thereby moving said link means to actuate said brake means.

17. The brake system according to claim 16 in which the geometry between said pivot pin means and said axis of rotation of said pulleys is such that as said brake means wears, the leverage applied by the rotation of said winch drum in said opposite direction increases thereby automatically increasing the braking action as the wear increases on said brake means.

18. The braking system according to claim 17 in which said link means is adjustable in length to vary the braking affect of said braking system.

19. The braking system according to claim 13 in which said cable drum is rotatable in one direction when said platform is elevating and in the opposite direction when said platform is descending and one way clutch means operatively engaging between said cable drum and said brake drum to selectively lock said cable drum to said brake drum when said cable drum be gins to rotate in said opposite direction.

20. The braking system according to claim 19 in which rotation of said cable drum in said opposite direction by said winch assembly overcomes the effective said braking system whereby said platform descends in a controlled manner.

* * * * *